US006300292B2

(12) United States Patent
Konishi et al.

(10) Patent No.: US 6,300,292 B2
(45) Date of Patent: Oct. 9, 2001

(54) HYDRAULIC OIL COMPOSITION

(75) Inventors: Toru Konishi; Yoshinobu Kikuchi, both of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/773,481

(22) Filed: Feb. 2, 2001

(30) Foreign Application Priority Data

Feb. 4, 2000 (JP) ..... 12-027939

(51) Int. Cl.[7] ..... C10M 169/04; C10M 14/102

(52) U.S. Cl. ..... 508/371; 508/491; 508/545; 508/584

(58) Field of Search ..... 508/371, 491, 508/545, 584

(56) References Cited

U.S. PATENT DOCUMENTS 5,413,725 * 5/1995 Lal et al. ..... 508/280
5,451,332 * 9/1995 Lawate ..... 508/280
5,736,493 * 4/1998 Garmier ..... 508/150
5,858,934 * 1/1999 Wiggins et al. ..... 508/491
5,858,935 * 1/1999 Watts et al. ..... 508/365
5,900,055 * 11/1999 Garmier ..... 508/491
5,958,851 * 9/1999 Cannon et al. ..... 508/491
5,972,855 * 10/1999 Honary ..... 508/491

* cited by examiner

*Primary Examiner*—Jacqueline V. Howard
(74) *Attorney, Agent, or Firm*—Kubovcik & Kubovcik

(57) ABSTRACT

An object is to provide a hydraulic oil composition which is excellent in oxidative stability, lubricating properties and biodegradability. A hydraulic oil composition comprising vegetable oil with a total degree of unsaturation of 0.3 or less as base oil, and comprising at least one antioxidant selected from the group consisting 6f a phenol antioxidant, an amine antioxidant and a zinc dithiophosphate antioxidant in an amount of 0.01 to 5% by mass based on the total amount of the composition.

6 Claims, No Drawings

HYDRAULIC OIL COMPOSITION

BACKGROUND OF THE INVENTION

1. Technical Field

The present invention relates to a hydraulic oil composition used in hydraulic devices etc. in the fields of architecture etc. and in particular to a hydraulic oil composition excellent in oxidative stability and lubricating properties and superior in biodegradability.

2. Description of the Prior Art

The hydraulic oil used in hydraulic devices such as constructing machines may be leaked into soil or rivers so that biodegradable hydraulic oil is often used for the environment. As the base oil in the biodegradable hydraulic oil, synthetic esters and vegetable oil are generally used, but the synthetic esters have the problem of higher prices and the synthetic esters excellent in biodegradability have the disadvantage of being inferior in oxidative stability. On the other hand, the vegetable oil is naturally occurring oil and is thus excellent in biodegradability and superior in respect of lower prices, but it is poor in oxidative stability, and because the conventional hydraulic oil using said vegetable oil as the base oil has the problems of its easily increasing viscosity during its use, easy formation of sludge, etc., it is difficult to use the conventional hydraulic oil under severe environments such as high temperatures, high loading and the like.

SUMMARY OF THE INVENTION

An object of the present invention is to provide a hydraulic oil composition comprising vegetable oil as base oil, which is excellent in oxidative stability, lubricating properties and biodegradability.

The biodegradable hydraulic oil composition of the present invention was made by paying attention to a combination of vegetable oil having a specific degree of unsaturation and specific additives in order to solve the problem described above.

That is, the first aspect of the invention relates to a hydraulic oil composition comprising vegetable oil with a total degree of unsaturation of 0.3 or less as base oil, and comprising at least one antioxidant selected from the group consisting of a phenol antioxidant, an amine antioxidant and a zinc dithiophosphate antioxidant in an amount of 0.01 to 5% by mass based on the total amount of the composition.

The second aspect of the present invention relates to the hydraulic oil composition described above, wherein said vegetable oil has an oleic acid content of not less than 70% by mass in triglyceride-constituting fatty acids.

DETAILED DESCRIPTION OF THE INVENTION

Hereinafter, the present invention is described in detail.

The base oil in the hydraulic oil composition of the present invention is vegetable oil with a total degree of unsaturation of 0.3 or less. Preferably, vegetable oil with a total degree of unsaturation of 0.2 or less can be used. If the total degree of unsaturation of the base oil used is higher than 0.3, the hydraulic oil composition of the present invention becomes inferior in oxidative stability, which is not preferable. The total degree of unsaturation referred to in the present invention means a total degree of unsaturation measured using the same device and procedure as those used in the "Polyether for Polyurethane Test Method" in JIS K1557-1970 except that vegetable oil is used in place of a polyether for polyurethane.

Further, the base oil in the present invention is preferably vegetable oil with an oleic acid content of not less than 70% by mass, more preferably not less than 80% by mass in triglyceride-constituting fatty acids. By using the vegetable oil with an oleic acid content of not less than 70% by mass, further improved oxidative stability of the composition can be achieved and further improvement in abrasion resistance is also achieved. The oleic acid content in vegetable oil referred to in the present invention means a content of oleic acid measured according to "2.4.2 Composition of Fatty Acid" in the Standard Methods for Analysis of Fats and Oils stipulated by the Japanese Society of Oil Chemistry.

According to the present invention, the kinematic viscosity of said vegetable oil is arbitrary and not particularly limited, but from the viewpoint of good lubricating properties and cooling properties (heat removability) and of less frictional loss by resistance to stirring, the kinematic viscosity thereof at 40° C. is preferably 10 to 10000 $mm^2/s$, more preferably 20 to 1000 $mm^2/s$.

The viscosity index of said vegetable oil is also arbitrary, and but for preventing a reduction of oil film thickness at high temperatures, the viscosity index thereof is preferably 50 to 500, more preferably 90 to 300. The pour point of said vegetable oil is also arbitrary, but in view of starting property of a pump in winter, generally the pour point thereof is preferably 0° C. or less, more preferably −5° C. or less.

The flash point of said vegetable oil is also arbitrary, but in view of the possibility of fire, the flash point is preferably 70° C. or more, more preferably 200° C. or more. The total acid value of said vegetable oil is also arbitrary and not particularly limited, but if a too large amount of free fatty acids are present as impurities, the hydraulic oil composition may be lowered in the oxidative stability and thus the total acid value is 0 to 2.0 mg KOH/g, more preferably 0 to 0.5 mg KOH/g.

A process for producing said vegetable oil used in the present invention is not particularly limited and any arbitrary processes are available as long as vegetable oil to be produced by said processes has properties as mentioned above. For instance, natural vegetable oil having a total degree of unsaturation of 0.3 or less can be used in the present invention as it is.

Further, there are a large number of natural vegetable oils having a total degree of unsaturation of over 0.3, and in a process of refining them, the total degree of unsaturation can be reduced by hydrogenation or the like.

It is also possible to obtain vegetable oil having a total degree of unsaturation of 0.3 or less by carrying out breeding (plant breeding) of natural vegetables or carrying out genetic recombination of natural vegetables, and vegetable oil thus obtained can also be used in the present invention. It is described that vegetable oil having a low total degree of unsaturation can be easily produced by genetic recombination technology in Japanese National Phase Laid-Open Gazette No. Hei 11-508961 (publication date: Aug. 3, 1999) entitled "Soybean Oil Having High Oxidative Stability."

It is also possible to obtain vegetable oil having a high oleic acid content in triglyceride as well as having a low total degree of unsaturation by said breeding (plant breeding) or genetic recombination of natural vegetables.

The type of vegetable oil used in the present invention is not particularly limited, but rapeseed oil, sunflower oil, soybean oil, corn oil, canola oil, mixed oil thereof and oil obtained by hydrogenating them can be preferably used Further, rapeseed oil, sunflower oil, soybean oil, corn oil, canola oil, which are obtained by breeding (plant breeding) or genetic recombination, can also be used. Among them, sunflower oil, soybean oil, and sunflower oil and soybean oil which are obtained by breeding (plant breeding) or genetic recombination, can be preferably used.

According to the present invention, mineral oil and synthetic oil (diester, polyol ester etc.) can be contained as base oil in the hydraulic oil composition. The content of mineral oil is preferably 20% by mass or less, and the content of synthetic oil is 50% by mass or less, relative to the total amount of the base oil. Examples of diesters of said synthetic oil are dioctyl adipate, dioctyl phthalate, dioctyl sebacate etc., and examples of polyol esters are trimethylol propane ester such as trimethylol propane trioleate etc., pentaerythritol ester such as pentaerythritol tetraoleate etc., and neopentyl glycol ester such as neopentyl glycol dioleate and the like.

The hydraulic oil composition of the present invention comprises at least one antioxidant selected from the group consisting of a phenol antioxidant, an amine antioxidant and a zinc dithiophosphate antioxidant, and these antioxidants are now described.

The phenol antioxidant may be any arbitrary phenol compound used as an antioxidant in lubricating oil and is not particularly limited, and one or more alkyl phenol compounds selected from the compounds represented by formula (1) or (2) below can be mentioned as preferable examples.

(1)

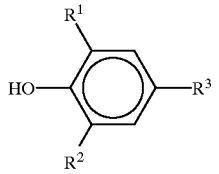

wherein $R^1$ represents a $C_{1-4}$ alkyl group, $R^2$ represents a hydrogen atom or a $C_{1-4}$ alkyl group, and $R^3$ represents a hydrogen atom, a $C_{1-4}$ alkyl group, or a group represented by formula (i) or (ii):

(i)

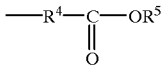

wherein $R^4$ represents a $C_{1-6}$ alkylene group and $R^5$ represents a $C_{1-24}$ alkyl or alkenyl group;

(ii)

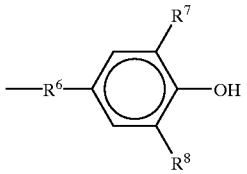

wherein $R^6$ represents a $C_{1-6}$ alkylene group, $R^7$ represents a $C_{1-4}$ alkyl group, and $R^8$ represents a hydrogen atom or a $C_{1-4}$ alkyl group.

(2)

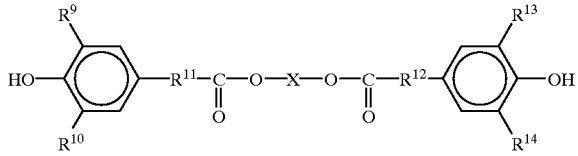

wherein $R^9$ and $R^{13}$ independently represent a $C_{1-4}$ alkyl group, $R^{10}$ and $R^{14}$ independently represent a hydrogen atom or a $C_{1-4}$ alkyl group, $R^{11}$ and $R^{12}$ independently represent a $C_{1-6}$ alkylene group, and X represents a $C_{1-18}$ alkylene group or a group represented by formula (iii):

$$—R^{15}—S—R^{16}— \quad \text{(iii)}$$

wherein $R^{15}$ and $R^{16}$ independently represent a $C_{1-6}$ alkylene group.

In the formula (1), $R^1$ is specifically a methyl group, ethyl group, n-propyl group, isopropyl group, n-butyl group, isobutyl group, sec-butyl group, tert-butyl group etc., among which the tert-butyl group is preferable for achieving good oxidative stability of the composition. $R^2$ includes a hydrogen atom and $C_{1-4}$ alkyl groups such as those described above, among which the methyl or tert-butyl group is preferable for achieving good oxidative stability of the composition.

When $R^3$ in the formula (1) is a $C_{1-4}$ alkyl group, $R^3$ is specifically a methyl group, ethyl group, n-propyl group, isopropyl group, n-butyl group, isobutyl group, sec-butyl group, tert-butyl group etc., among which the methyl or ethyl group is preferable for achieving good oxidative stability of the composition.

Among the alkyl phenols represented by formula (1), those compounds particularly preferable when $R^3$ is a $C_{1-4}$ alkyl group are 2,6-di-tert-butyl-p-cresol, 2,6-di-tert-butyl-4-methyl phenol, 2,6-di-tert-butyl-4-ethyl phenol and mixtures thereof.

When $R^3$ in the formula (1) is a group represented by formula (i), the $C_{1-6}$ alkylene group indicated by $R^4$ in formula (i) may be straight-chain or branched and includes a methylene group, methyl methylene group, ethylene group (dimethylene group), ethyl methylene group, propylene group (methyl ethylene group), trimethylene group, straight-chain or branched butylene group, straight-chain or branched pentylene group, straight-chain or branched hexylene group, etc.

In order that the compounds represented by the formula (1) can be produced in a less number of reaction steps, $R^4$ is more preferably a $C_{1-2}$ alkylene group such as a methylene group, methyl methylene group, ethylene group (dimethylene group) or the like.

The $C_{1-24}$ alkyl or alkenyl group indicated by $R^5$ in formula (i) may be straight-chain or branched and includes alkyl groups such as methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, icocyl group, heneicosyl group, docosyl group, tricosyl group and tetracosyl group (these alkyl groups may be straight-chain or branched) and alkenyl groups such as vinyl group, propenyl group, isopropenyl group, butenyl group, pentenyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, octadecadienyl group, nonadecenyl group, icocenyl group, heneicocenyl group, dococenyl group, tricocenyl group and tetracocenyl group (these alkenyl groups may be straight-chain or branched, and the position of their double bond is also arbitrary).

For exhibiting excellent solubility in base oil, $R^5$ is preferably a $C_{4-18}$ alkyl group such as a butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group and octadecyl group (these alkyl groups may be straight-chain or branched), more preferably a $C_{6-12}$ straight-chain or branched alkyl group and most preferably a $C_{6-12}$ branched alkyl group.

Those phenol compounds of formula (1) wherein $R^3$ is a group represented by formula (i) are preferably those of formula (1) wherein in formula (i) $R^4$ is a $C_{1-2}$ alkylene group and $R^5$ is a $C_{6-12}$ straight-chain or branched alkyl group, more preferably those of formula (1) wherein in formula (i) $R^4$ is a $C_{1-2}$ alkylene group and $R^5$ is a $C_{6-12}$ branched alkyl group.

More preferable examples of such compounds are n-hexyl (3-methyl-5-tert-butyl-4-hydroxyphenyl) acetate, isohexyl (3-methyl-5-tert-butyl-4-hydroxyphenyl) acetate, n-heptyl (3-methyl-5-tert-butyl-4-hydroxyphenyl) acetate, isoheptyl (3-methyl-5-tert-butyl-4-hydroxyphenyl) acetate, n-octyl (3-methyl-5-tert-butyl-4-hydroxyphenyl) acetate, isoctyl (3-methyl-5-tert-butyl-4-hydroxyphenyl) acetate, 2-ethylhexyl (3-methyl-5-tert-butyl-4-hydroxyphenyl) acetate, n-nonyl (3-methyl-5-tert-butyl -4-hydroxyphenyl) acetate, isononyl (3-methyl-5-tert-butyl-4-hydroxyphenyl) acetate, n-decyl (3-methyl-5-tert-butyl-4-hydroxyphenyl) acetate, isodecyl (3-methyl-5-tert-butyl-4-hydroxyphenyl) acetate, n-undecyl (3-methyl-5-tert-butyl-4-hydroxyphenyl) acetate, isoundecyl (3-methyl-5-tert-butyl-4-hydroxyphenyl) acetate, n-dodecyl (3-methyl-5-tert-butyl-4-hydroxyphenyl) acetate, isododecyl ( 3-methyl-5-tert-butyl-4-hydroxyphenyl) acetate, n-hexyl (3-methyl-5-tert-butyl-4-hydroxyphenyl) propionate, isohexyl (3-methyl-5-tert-butyl-4-hydroxyphenyl) propionate, n-heptyl (3-methyl-5-tert-butyl-4-hydroxyphenyl) propionate, isoheptyl (3-methyl-5-tert-butyl-4-hydroxyphenyl) propionate, n-octyl (3-methyl-5-tert-butyl-4-hydroxyphenyl) propionate, isooctyl (3-methyl-5-tert-butyl-4-hydroxyphenyl) propionate, 2-ethylhexyl (3-methyl-5-tert-butyl-4-hydroxyphenyl) propionate, n-nonyl (3-methyl-5-tert-butyl-4-hydroxyphenyl) propionate, isononyl (3-methyl-5-tert-butyl-4-hydroxyphenyl) propionate, n-decyl (3-methyl-5-tert-butyl-4-hydroxyphenyl) propionate, isodecyl (3-methyl-5-tert-butyl-4-hydroxyphenyl) propionate, n-undecyl (3-methyl-5-tert-butyl -4-hydroxyphenyl) propionate, isoundecyl (3-methyl-5-tert-butyl-4-hydroxyphenyl) propionate, n-dodecyl (3-methyl-5-tert-butyl-4-hydroxyphenyl) propionate, isododecyl (3-methyl-5-tert-butyl-4-hydroxyphenyl) propionate, n-hexyl (3,5-di-tert-butyl-4-hydroxyphenyl) acetate, isohexyl (3,5-di-tert-butyl-4-hydroxyphenyl) acetate, n-heptyl (3,5-di-tert-butyl-4-hydroxyphenyl) acetate, isoheptyl (3,5-di-tert-butyl-4-hydroxyphenyl) acetate, n-octyl (3,5-di-tert-butyl-4-hydroxyphenyl) acetate, isooctyl (3,5-di-tert-butyl-4-hydroxyphenyl) acetate, 2-ethylhexyl (3,5-di-tert-butyl-4-hydroxyphenyl) acetate, n-nonyl (3,5-di-tert-butyl-4-hydroxyphenyl) acetate, isononyl (3,5-di-tert-butyl-4-hydroxyphenyl) acetate, n-decyl (3,5-di-tert-butyl-4-hydroxyphenyl) acetate, isodecyl (3,5-di-tert-butyl-4-hydroxyphenyl) acetate, n-undecyl (3,5-di-tert-butyl-4-hydroxyphenyl) acetate, isoundecyl (3,5-di-tert-butyl-4-hydroxyphenyl) acetate, n-dodecyl (3,5-di-tert-butyl-4-hydroxyphenyl) acetate, isododecyl (3,5-di-tert-butyl-4-hydroxyphenyl) acetate, n-hexyl (3,5-di-tert-butyl-4-hydroxyphenyl) propionate, isohexyl (3,5-di-tert-butyl-4-hydroxyphenyl) propionate, n-heptyl (3,5-di-tert-butyl-4-hydroxyphenyl) propionate, isoheptyl (3,5-di-tert-butyl-4-hydroxyphenyl) propionate, n-octyl (3,5-di-tert-butyl-4-hydroxyphenyl) propionate, isooctyl (3,5-di-tert-butyl-4-hydroxyphenyl) propionate, 2-ethylhexyl (3,5-di-tert-butyl-4-hydroxyphenyl) propionate, n-nonyl (3,5-di-tert-butyl-4-hydroxyphenyl) propionate, isononyl (3,5-di-tert-butyl-4-hydroxyphenyl) propionate, n-decyl (3,5-di-tert-butyl-4-hydroxyphenyl) propionate, isodecyl (3,5-di-tert-butyl-4-hydroxyphenyl) propionate, n-undecyl (3,5-di-tert-butyl-4-hydroxyphenyl) propionate, isoundecyl (3,5-di-tert-butyl-4-hydroxyphenyl) propionate, n-dodecyl (3,5-di-tert-butyl-4-hydroxyphenyl) propionate, isododecyl (3,5-di-tert-butyl-4-hydroxyphenyl) propionate, and mixtures thereof.

When $R^3$ in formula (1) is a group represented by formula (ii), $R^6$ in formula (ii) represents a $C_{1-6}$ alkylene group. This alkylene group may be straight-chain or branched, and specifically, the various alkylene groups exemplified above for $R^4$ can be mentioned. In order that the compounds of formula (1) can be produced in a less number of reaction steps and their raw materials are easily available, $R^6$ is more preferably a $C_{1-3}$ alkylene group such as a methylene group, methyl methylene group, ethylene group (dimethylene group), ethyl methylene group, propylene group (methyl ethylene group), trimethylene group or the like.

$R^7$ in formula (ii) includes a methyl group, ethyl group, n-propyl group, isopropyl group, n-butyl group, isobutyl group, sec-butyl group, tert-butyl group etc., among which the tert-butyl group is preferable for good oxidative stability of the composition. $R^8$ includes a hydrogen atom and $C_{1-4}$ alkyl groups such as those described above, among which the methyl or tert-butyl group is preferable for good oxidative stability of the composition.

Among those alkyl phenols represented by formula (1), those compounds wherein $R^3$ is a group represented by formula (ii) preferably include bis(3,5-di-tert-butyl-4-hydroxyphenyl) methane, 1,1- bis(3,5-di-tert-butyl-4-hydroxyphenyl) ethane, 1,2-bis(3,5-di-tert-butyl-4-hydroxyphenyl) ethane, 1,1-bis(3,5-di-tert-butyl-4-hydroxyphenyl) propane, 1,2-bis(3,5-di-tert-butyl-4-hydroxyphenyl) propane, 1,3-bis(3,5-di-tert-butyl-4-hydroxyphenyl) propane, 2,2-bis(3,5-di-tert-butyl-4-hydroxyphenyl) propane, and mixtures thereof.

In the formula (2) above, $R^9$ and $R^{13}$ independently represent a $C_{1-4}$ alkyl group such as a methyl group, ethyl group, n-propyl group, isopropyl group, n-butyl group, isobutyl group, sec-butyl group, tert-butyl group etc., and preferably both of $R^9$ and $R^{13}$ are tert-butyl groups for good oxidative stability of the composition. $R^{10}$ and $R^{14}$ independently represent a hydrogen atom or $C_{1-4}$ alkyl groups such as those described above, and preferably $R^{10}$ and $R^{14}$ are independently methyl or tert-butyl groups for good oxidative stability of the composition.

In formula (2), the $C_{1-6}$ alkylene group indicated by $R^{11}$ and $R^{12}$ may be straight-chain or branched, and specifically $R^{11}$ and $R^{12}$ independently represent the various alkylene groups exemplified above for $R^4$. For the production of the compounds of formula (2) in a less number of reaction steps and for the easy availability of their raw materials, it is more preferable that $R^{11}$ and $R^{12}$ be independently $C_{1-2}$ alkylene groups such as a methylene group, methyl methylene group, ethylene group (dimethylene group).

In formula (2), the $C_{1-18}$ alkylene group indicated by X includes a methylene group, methyl methylene group, ethylene group (dimethylene group), ethyl methylene group, propylene group (methyl ethylene group), trimethylene group, butylene group, pentylene group, hexylene group, heptylene group, octylene group, nonylene group, decylene group, undecylene group, dodecylene group, tridecylene group, tetradecylene group, pentadecylene group, hexadecylene group, heptadecylene group, octadecylene group or the like (these alkylene groups may be straight-chain or branched), and for the easy availability of their raw materials, these alkylene groups are more preferably $C_{1-6}$ alkylene groups such as methylene group, methyl methylene group, ethylene group (dimethylene group), ethyl methylene group, propylene group (methyl ethylene group), trimethylene group, butylene group, pentylene group, hexylene group and the like (these alkylene groups may be straight-chain or branched), most preferably $C_{2-6}$ straight-chain alkylene groups such as ethylene group (dimethylene group), trimethylene group, straight-chain butylene group (tetramethylene group), straight-chain pentylene group (pentamethylene group), straight-chain hexylene group (hexamethylene group) and the like.

Among the alkyl phenols represented by formula (2), a particularly preferable compound in the cases where X is a $C_{1-18}$ alkylene group, is a compound represented by formula (3) as follows:

(3)

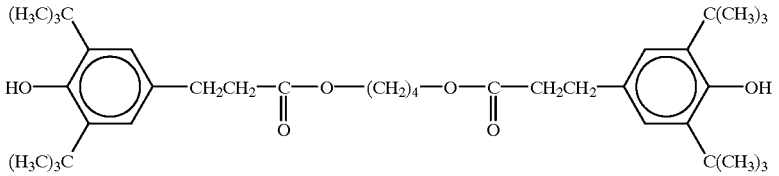

When X in formula (2) is a group represented by formula (iii), the $C_{1-6}$ alkylene groups indicated by $R^{15}$ and $R^{16}$ in formula (iii) may be straight-chain or branched, and independently include a wide variety of alkylene groups such as those exemplified above for $R^4$. For easy availability of raw materials used for producing the compounds of formula (2), it is preferable that $R^{15}$ and $R^{16}$ be independently $C_{1-3}$ alkylene groups such as methylene group, methyl methylene group, ethylene group (dimethylene group), ethyl methylene group, propylene group (methyl ethylene group), trimethylene group and the like.

Among the alkyl phenols represented by formula (2), a particularly preferable compound in the cases where X is a group represented by formula (iii) is a compound represented by formula (4) as follows:

(4)

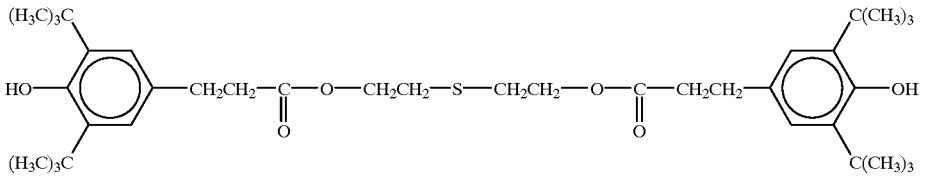

The amine antioxidant used in the present invention may be any arbitrary amine compound used as an antioxidant in lubricating oil and is not particularly limited, and one or more aromatic amines selected from e.g. phenyl-a-naphthyl amine and N-p-alkylphenyl-α-naphthyl amine represented by formula (5) and p,p'-dialkyl diphenyl amine represented by formula (6) can be mentioned as preferable examples. Among these, phenyl-α-naphthyl amine or N-p-alkylphenyl-α-naphthyl amine represented by formula (5) is particularly preferable for good durability of the antioxidant effect.

(5)

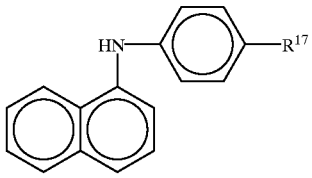

wherein $R^{17}$ represents a hydrogen atom or an alkyl group.

(6)

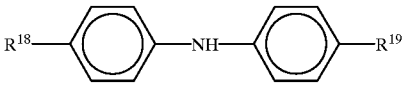

wherein $R^{18}$ and $R^{19}$ independently represent an alkyl group.

In formula (5), $R^{17}$ represents a hydrogen atom or an alkyl group, but the compound wherein $R^{17}$ is a hydrogen atom is particularly preferable because it exhibits the antioxidant effect effectively at low concentration. The alkyl group is preferably a group containing 16 or less carbon atoms in order to achieve a higher antioxidant effect.

Such alkyl groups may be straight-chain and/or branched. Examples of the alkyl groups represented by $R^{17}$ are a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group and the like (these alkyl groups may be straight-chain or branched).

For exhibiting good solubility of their oxidized product in base oil, these $C_{16}$ or less alkyl groups are preferably $C_{8-16}$ branched alkyl groups, more preferably those $C_{8-16}$ branched alkyl groups derived from oligomers of $C_3$ or $C_4$ olefins. The $C_3$ or $C_4$ olefins referred to here include propylene, 1-butene, 2-butene and isobutylene, among which propylene and isobutylene are preferable for good solubility of their oxidized product in base oil.

Specifically, a branched octyl group derived from an isobutylene dimer, a branched nonyl group derived from a propylene trimer, a branched dodecyl group derived from an isobutylene trimer, a branched dodecyl group derived from a propylene tetramer or a branched pentadecyl group derived from a propylene pentamer is particularly preferable.

The N-p-alkylphenyl-α-naphthyl amine represented by formula (5) may be a commercially available product, but can be easily produced by reacting phenyl-α-naphthyl amine with a $C_{1-6}$ alkyl halide, a $C_{2-6}$ olefin, or a $C_{2-6}$ olefin oligomer with phenyl-a-naphthyl amine by use of a Friedel-Crafts catalyst. Examples of the Friedel-Crafts catalyst are metal halides such as aluminum chloride, zinc chloride and iron chloride, and acidic catalysts such as sulfuric acid, phosphoric acid, phosphorus pentoxide, boron fluoride, acidic clay and active clay.

In the formula (6) indicative of p,p'-dialkyl diphenyl amine, $R^{18}$ and $R^{19}$ independently represent an alkyl group among which a $C_{16}$ or less alkyl group is preferable for achieving a higher antioxidant effect.

Specifically, $R^{18}$ and $R^{19}$ include a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group etc. (these alkyl groups may be straight-chain or branched). Among these groups, the $C_{3-16}$ branched alkyl groups are preferable, and the $C_{3-6}$ branched alkyl groups derived from $C_3$ or $C_4$ olefins or from oligomers thereof are more preferable as $R^{18}$ and $R^{19}$ for achieving good solubility of their oxidized product in base oil.

The $C_3$ or $C_4$ olefins referred to herein include propylene, 1-butene, 2-butene and isobutylene, among which propylene and isobutylene are preferable for good solubility of their oxidized product in base oil in lubricating oil. Specifically, an isopropyl group derived from propylene, a tert-butyl group derived from isobutylene, a branched hexyl group derived from a propylene dimer, a branched octyl group derived from an isobutylene dimer, a branched nonyl group derived from a propylene trimer, a branched dodecyl group derived from an isobutylene trimer, a branched dodecyl group derived from a propylene tetramer or a branched pentadecyl group derived from a propylene pentamer is particularly preferable.

The p,p'-dialkyl diphenyl amine represented by formula (6) may be a commercially available product. Like the N-p-alkylphenyl-α-naphthyl amine represented by formula (5), the p,p'-dialkyl diphenyl amine can also be easily produced by reacting diphenyl amine with a $C_{1-16}$ alkyl halide a $C_{2-16}$ olefin, or $C_{2-6}$ olefins or an oligomer of $C_{2-6}$ olefins with diphenyl amine by use of a Friedel-Crafts catalyst. Examples of the Friedel-Crafts catalyst are the metal halides and acidic catalysts exemplified for synthesis of the N-p-alkylphenyl-α-naphthyl amine.

The amine antioxidant includes 4-butyl-4'-octyl diphenyl amine, phenyl-α-naphthyl amine, octyl phenyl-α-naphthyl amine, dodecyl phenyl-α-naphthyl amine and mixtures thereof.

As the zinc dithiophosphate antioxidant used in the present invention, the zinc dithiophosphates represented by formula (7) below can be exemplified.

(7)

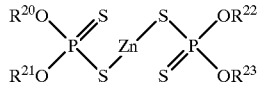

wherein $R^{20}$, $R^{21}$, $R^{22}$ and $R^{23}$ independently represent a $C_{1-8}$ alkyl group, an aryl group and a $C_{7-8}$ alkyl aryl group.

Specifically, the alkyl group includes a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group or the like, among which those alkyl groups containing 3 to 8 carbon atoms are generally used. These alkyl groups include straight-chain or branched groups. Further, these groups include primary and secondary alkyl groups.

For introduction of $R^{20}$, $R^{21}$, $R^{22}$ and $R^{23}$, a mixture of α-olefins may be used as a raw material, and in this case, a mixture of zinc dialkyl dithiophosphates different from one another in the structure of the alkyl group is produced as the compounds represented by formula (7).

The aryl group includes a phenyl group, naphthyl group and the like.

The alkyl aryl group includes a tolyl group, xylyl group, ethyl phenyl group, propyl phenyl group, butyl phenyl group, pentyl phenyl group, hexyl phenyl group, heptyl phenyl group, octyl phenyl group, nonyl phenyl group, decyl phenyl group, undecyl phenyl group, dodecyl phenyl group and the like (these alkyl groups include not only straight-chain or branched groups but also every possible substitution isomers).

Examples of the zinc dithiophosphate antioxidant are zinc di(2-ethylhexyl) dithiophosphate, zinc di(1,3-dimethylbutyl) dithiophosphate, zinc diisopropyl dithiophosphate and mixtures thereof.

The hydraulic oil composition of the present invention comprises at least one antioxidant selected from the group consisting of a phenol antioxidant, an amine antioxidant and a zinc dithiophosphate antioxidant, and one compound selected from these antioxidants may be used alone or a mixture of two or more compounds selected from the described compounds may be used in an arbitrary ratio. In a mixture of e.g. two compounds, the mixture ratio by weight may be 1:1, and in a mixture of three compounds, the mixture ratio by weight may be 1:1:1.

Among these antioxidants, the amine antioxidant is preferably used for achieving good oxidative stability, lubricating properties and biodegradability of a blended composition obtained.

The upper limit of the total content of the antioxidant(s) in the hydraulic oil composition of the present invention is 5% by mass, preferably 3% by mass and more preferably 1% by mass relative to the total amount of the composition. A content of more than 5% by mass is not preferable because the oxidative stability and the sludge formation-inhibiting effect of the composition cannot be improved in proportion to the content of the antioxidant, and further because the solubility of the antioxidant(s) in base oil is lowered.

The lower limit of the total content of the antioxidant(s) is 0.01% by mass, preferably 0.05% by mass and more preferably 0.1% by mass relative to the total amount of the composition. A content of less than 0.01% by mass is not preferable because the effect of the antioxidant(s) added is not recognized and the oxidative stability and the sludge formation-inhibiting effect of the hydraulic oil composition may be lowered.

In the present invention, a hydraulic oil composition excellent in oxidative stability, lubricating properties and biodegradability can be obtained by merely incorporating the above-described antioxidant in a specific amount into base oil i.e. lubricating oil (vegetable oil) having a total degree of unsaturation of 0.3 or less as described above, but for the purpose of further improving its performance, various additives such as a rust preventive, a metal-deactivating agent, a viscosity index improver, a pour point depressant, a defoaming agent may be contained alone or in combination thereof in the hydraulic oil composition.

The rust preventive includes metal soaps such as fatty acid metal salts, lanolin fatty acid metal salts, oxidized wax metal salts; polyvalent alcohol partial esters such as sorbitan fatty acid esters; esters such as lanolin fatty acid esters; sulfonates such as calcium sulfonate, barium sulfonate; oxidized wax; amines; phosphoric acid; phosphates. In the present invention, one or more compounds selected arbitrarily from these rust preventives can be contained in an arbitrary amount in the hydraulic oil composition, and usually the content thereof is desirably 0.01 to 1% by mass relative to the total amount of the hydraulic oil composition.

The metal-deactivating agent includes a benzotriazole compound, a thiaziazole compound or an imidazole compound. In the present invention, one or more compounds selected arbitrarily from these metal-deactivating agents can be contained in an arbitrary amount in the hydraulic oil composition, and usually the content thereof is desirably 0.001 to 1% by mass relative to the total amount of the hydraulic oil composition.

The viscosity index improver includes the so-called non-dispersible viscosity index improvers such as copolymers of one or more monomers selected from various methacrylates, and hydrogenated products thereof, ethylene-α-olefin copolymers (propylene, 1-butene, 1-pentene etc. can be exemplified as an α-olefin) and hydrogenated products thereof, polyisobutylene and hydrogenated products thereof, styrene-diene hydrogenated copolymers and polyalkyl styrene. In the present invention, one or more compounds selected arbitrarily from these viscosity index improvers can be contained in an arbitrary amount in the hydraulic oil composition, and usually the content thereof is desirably 0.01 to 10% by mass relative to the total amount of the hydraulic oil composition.

The pour point depressant includes copolymers of one or more monomers selected from various acrylates and methacrylates, as well as hydrogenated products thereof. In the present invention, one or more compounds selected arbitrarily from these pour point depressants can be contained in an arbitrary amount in the hydraulic oil composition, and usually the content thereof is desirably 0.01 to 5% by mass relative to the total amount of the hydraulic oil composition.

The defoaming agent includes silicones such as dimethyl silicone, fluorosilicone. In the present invention, one or more compounds selected arbitrarily from these defoaming agents can be contained in an arbitrary amount in the hydraulic oil composition, and usually the content thereof is desirably 0.001 to 0.05% by mass relative to the total amount of the hydraulic oil composition.

The kinematic viscosity of the hydraulic oil composition of the present invention is arbitrary and not particularly limited, but from the viewpoint of good lubricating properties and cooling properties (heat removability) and of less frictional loss by resistance to stirring, the kinematic viscosity thereof at 40° C. is preferably 10 to 10000 $mm^2/s$, more preferably 20 to 1000 $mm^2/s$.

The viscosity index of the hydraulic oil composition is also arbitrary, but for preventing a reduction of oil film thickness at high temperatures, the viscosity index thereof is preferably 50 to 500, more preferably 90 to 300. Further, the pour point of the hydraulic oil composition is also arbitrary, but in view of starting property of a pump in winter, generally the pour point thereof is preferably 0° C. or less, more preferably −5° C. or less.

The flash point of the composition is also arbitrary, but in view of the possibility of fire, the flash point is preferably 70° C. or more, more preferably 200° C. or more. The total acid value of the composition is also arbitrary and not particularly limited, but if a too large amount of free fatty acids are present as impurities, the hydraulic oil composition may be lowered in the oxidative stability and thus the total acid value is 0 to 2.0 mg KOH/g, more preferably 0 to 0.5 mg KOH/g.

The hydraulic oil composition of the present invention is used particularly preferably as hydraulic oil used in hydraulic devices such as constructing machines, automobiles etc., and it also exhibits good performance as hydraulic oil in other hydraulic devices such as steel facilities, injection-molding machine, machine tools, industrial robots, hydraulic elevators and the like. Further, the hydraulic oil composition of the present invention has a high flash point and is thus preferably usable as fire-resistant hydraulic oil used in a site with possibility of fire.

EXAMPLES

Hereinafter, the present invention is described in more detail by reference to the Examples and Comparative Examples, which are however not intended to limit the present invention.

Examples 1 to 15 and Comparative Examples 1 to 2

Using the base oils shown in Table 1 and the compositions shown in Tables 2 to 4, the hydraulic oil compositions of the present invention (Examples 1 to 15) and comparative hydraulic oil compositions (Comparative Examples 1 to 2) were prepared. These compositions were examined in a thermal stability test, a four-ball test and a biodegradability test shown below, and the results are shown in Tables 2 to 4.

Thermal Stability Test

An increase in the total acid value of lubricating oil (hydraulic oil composition) was evaluated in accordance with JIS K2540-1989 "Lubricating Oil Thermal stability Test Method." That is, 50 ml of prepared lubricating oil was introduced into a 100-ml beaker and the beaker containing the lubricating oil was left for 240 hours in a high-temperature bath at 140 ° C. The increase in the total acid value thereof was determined by diluting thus obtained lubricating oil with n-hexane, filtering the diluted oil through a 0.8 $\mu$m membrane filter, measuring the total acid value of the filtered oil, and comparing the total acid value measured with that of new oil.

Four-Ball Test

This test was conducted in accordance with the Standard Test Method for Measurement of Extreme-Pressure Properties of Lubricating Fluids (Four-Ball Method) stipulated under ASTM D2783-88 (reapproved in 1993) as follows:

Lubricating oil was placed in a stipulated test machine and the test machine was operated under the conditions of 1200 rpm, a loading of 30 kg and a test time of 30 minutes, and then an average wear scar in diameter of 3 fixed balls was determined as a wear scar in diameter.

Biodegradation Test

This test was conducted in accordance with OECD 301C "Modified MITI-Method Test." That is, using active sludge as a microbial source, a test sample was prepared such that the concentration of the microbial source was 30 mg/l in terms of solid content and the concentration of the oil composition was 100 mg/l, and the biodegradability of the oil composition was determined with an oxygen consumption automatic analyzer in a closed system by measuring its BOD/TOD and the concentration of residual chemicals during the period of 14 days at a temperature of 25±1° C.

TABLE 3

| | Ex. 10 | Ex. 11 | Ex. 12 | Ex. 13 | Ex. 14 | Ex. 15 |
|---|---|---|---|---|---|---|
| Base oil A* | 99.5 | — | — | 99.5 | — | — |
| Base oil B* | — | 99.5 | — | — | 99.5 | — |
| Base oil C* | — | — | 99.5 | — | — | 99.5 |
| Amine antioxidant 3* | 0.5 | 0.5 | 0.5 | — | — | — |
| Zinc dithiophosphate* | — | — | — | 0.5 | 0.5 | 0.5 |
| Thermal stability test | 0.20 | 0.20 | 0.32 | 0.35 | 0.34 | 0.47 |
| Increase in total acid value mgKOH/g | | | | | | |
| Four-Ball test | 0.31 | 0.32 | 0.39 | 0.26 | 0.27 | 0.29 |
| Wear scar in diameter mm | | | | | | |
| Biodegradability % | 95 | 92 | 90 | 90 | 90 | 90 |

*% by mass

Amine antioxidant 3: octyl phenyl-α-naphthyl amine

Zinc dithiophosphate: zinc di(2-ethylhexyl) dithiophosphate

TABLE 1

| | Base oil A | Base oil B | Base oil C | Base oil D |
|---|---|---|---|---|
| Composition | High-oleic Soybean oil | High-oleic Sunflower oil | High-oleic Rapeseed oil | Rapeseed oil |
| Total degree of unsaturation | 0.14 | 0.16 | 0.25 | 0.47 |
| Fatty acids content wt % | 82 | 80 | 64 | 20 |
| Oleic acid content | | | | |
| Linolic acid content wt % | 5 | 8 | 20 | 65 |
| Palmitic acid content wt % | 7 | 7 | 5 | 6 |
| Stearic acid content wt % | 4 | 3 | 2 | 5 |
| Others wt % | 2 | 2 | 9 | 4 |
| Kinematic viscosity (40° C.) $mm^2/s$ | 42 | 40 | 36 | 35 |
| Viscosity index | 203 | 201 | 209 | 213 |
| Pour point ° C. | −15 | −12.5 | −20 | −22.5 |
| Flash point ° C. | 310 | 318 | 317 | 315 |
| Total acid value mgKOH/g | 0.07 | 0.04 | 0.05 | 0.08 |

TABLE 2

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Base oil A* | 99.5 | — | — | 99.5 | — | — | 99.5 | — | — |
| Base oil B* | — | 99.5 | — | — | 99.5 | — | — | 99.5 | — |
| Base oil C* | — | — | 99.5 | — | — | 99.5 | — | — | 99.5 |
| Phenol antioxidant* | 0.5 | 0.5 | 0.5 | — | — | — | — | — | — |
| Amine antioxidant 1* | — | — | — | 0.5 | 0.5 | 0.5 | — | — | — |
| Amine antioxidant 2* | — | — | — | — | — | — | 0.5 | 0.5 | 0.5 |
| Thermal stability test | 0.32 | 0.32 | 0.45 | 0.25 | 0.25 | 0.37 | 0.13 | 0.13 | 0.29 |
| Increase in total acid value mgKOH/g | | | | | | | | | |
| Four-Ball test | 0.31 | 0.33 | 0.37 | 0.32 | 0.32 | 0.38 | 0.31 | 0.32 | 0.37 |
| Wear scar in diameter mm | | | | | | | | | |
| Biodegradability % | 95 | 92 | 90 | 95 | 92 | 90 | 95 | 92 | 90 |

*% by mass

Phenol antioxidant: 2,6-di-tert-butyl-4-methyl phenol

Amine antioxidant 1: 4-butyl-4'-octyl diphenyl amine

Amine antioxidant 2: phenyl-α-naphthyl amine

TABLE 4

| | Comp. Ex. 1 | Comp. Ex. 2 |
|---|---|---|
| Base oil D* | 100 | 99.5 |
| Amine antioxidant * | — | 0.5 |
| Thermal stability test Increase in total acid value mg KOH/g | 15.4 | 9.6 |
| Four-Ball test Wear scar in diameter mm | 0.64 | 0.64 |
| Biodegradability % | 88 | 88 |

*% by mass
Amine antioxidant: phenyl-α-naphthyl amine

When the hydraulic oil compositions comprising as base oil vegetable oil having a total degree of unsaturation of 0.3 or less according to the present invention are compared with the hydraulic oil compositions comprising as base oil vegetable oil having a total degree of unsaturation of more than 0.3, the hydraulic oil compositions of the present invention are hardly oxidized even at a high temperature for a long time even if the same amount of the same amine oxidant as that added to the comparative ones is added thereto (that is, the increase in the total acid value is small), the wear of the material can be prevented (that is, the average wear scar in diameter of the fixed balls is small), and they can be biodegraded at higher degrees.

As described above, it is understood that the hydraulic oil composition of the present invention comprising specific vegetable oil as base oil is excellent in oxidative stability, lubricating properties and biodegradability.

What is claimed is:

1. A hydraulic oil composition comprising vegetable oil with a total degree of unsaturation of 0.3 or less as base oil, and comprising at least one antioxidant selected from the group consisting of a phenol antioxidant, an amine antioxidant and a zinc dithiophosphate antioxidant in an amount of 0.01 to 5% by mass based on the total amount of the composition.

2. The hydraulic oil composition according to claim 1, wherein said vegetable oil has an oleic acid content of not less than 70% by mass in triglyceride-constituting fatty acids.

3. The hydraulic oil composition according to claim 1, wherein said total degree of unsaturation is 0.2 or less.

4. The hydraulic oil composition according to claim 2, wherein said oleic acid content is not less than 80% by mass in triglyceride-constituting fatty acids.

5. The hydraulic oil composition according to claim 2, wherein said vegetable oil further comprises linolic acid, palmitic acid and stearic acid.

6. The hydraulic oil composition according to claim 1, which further comprises mineral oil and synthetic oil as base oil.

* * * * *